US012644218B2

(12) United States Patent
Reger et al.

(10) Patent No.: US 12,644,218 B2
(45) Date of Patent: Jun. 2, 2026

(54) DISPENSING ASSEMBLY FOR A WASHING MACHINE APPLIANCE

(71) Applicant: Haier US Appliance Solutions, Inc., Wilmington, DE (US)

(72) Inventors: Todd Anthony Reger, Crestwood, KY (US); Erick Flores Islas, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 46 days.

(21) Appl. No.: 18/589,000

(22) Filed: Feb. 27, 2024

(65) Prior Publication Data

US 2025/0270753 A1 Aug. 28, 2025

(51) Int. Cl.

| | |
|---|---|
| ***D06F 39/02*** | (2006.01) |
| ***D06F 23/02*** | (2006.01) |
| ***D06F 39/08*** | (2006.01) |

(52) U.S. Cl.

CPC ..... *D06F 39/028* (2013.01); *D06F 23/02* (2013.01); *D06F 39/02* (2013.01); *D06F 39/088* (2013.01)

(58) Field of Classification Search

CPC ..... D06F 23/02; D06F 39/02; D06F 39/028; D06F 39/088

See application file for complete search history.

(56) References Cited

U.S. PATENT DOCUMENTS 11,186,936 B2 11/2021 Park et al.
2005/0229652 A1* 10/2005 Kim ..... D06F 39/028 68/237
2005/0241072 A1* 11/2005 Kim ..... D06F 39/088 68/3 R
2005/0241347 A1* 11/2005 Cho ..... D06F 39/02 510/225
2005/0274156 A1* 12/2005 Yang ..... D06F 39/028 68/17 R
2012/0060568 A1* 3/2012 Buso ..... D06F 39/088 68/17 R
2012/0067089 A1* 3/2012 Buso ..... D06F 39/02 68/17 R (Continued)

FOREIGN PATENT DOCUMENTS

| | | |
|---|---|---|
| CN | 112301668 B | 7/2022 |
| EP | 0725182 B1 | 9/1999 |
| KR | 101095552 B1 | 12/2011 |

*Primary Examiner* — Joseph L. Perrin

(74) *Attorney, Agent, or Firm* — Dority & Manning, P.A.

(57) ABSTRACT

A washing machine appliance includes a wash tub positioned within a cabinet and defining a wash chamber, a wash basket rotatably mounted within the wash tub for receiving a load of clothes, and a dispensing assembly mounted within the cabinet for selectively adding wash fluid into the wash tub. The dispensing assembly includes a dispenser housing fluidly coupled to the wash tub through a discharge port, a shower plate positioned above the dispenser housing and defining a plurality of water supply apertures and one or more reservoirs, the one or more reservoirs comprising a main wash reservoir, a detergent drawer slidably mounted below the shower plate, the detergent drawer defining one or more detergent chambers, and a first cold water valve, a second cold water valve, and a hot water valve configured to supply either cold water or hot water to the main wash reservoir.

20 Claims, 8 Drawing Sheets

(56) References Cited

U.S. PATENT DOCUMENTS

| | | | | |
|---|---|---|---|---|
| 2017/0350060 | A1* | 12/2017 | Favaro | D06F 39/028 |
| 2019/0368111 | A1* | 12/2019 | Mariuzzo | D06F 39/02 |
| 2020/0018011 | A1* | 1/2020 | Lee | D06F 39/028 |
| 2020/0087837 | A1* | 3/2020 | Romito | D06F 39/10 |
| 2020/0087838 | A1* | 3/2020 | White | D06F 39/028 |
| 2020/0087839 | A1* | 3/2020 | White | D06F 34/22 |
| 2020/0216996 | A1* | 7/2020 | Del Pos | D06F 39/028 |
| 2022/0018050 | A1* | 1/2022 | Bernardino | D06F 23/02 |

* cited by examiner

DISPENSING ASSEMBLY FOR A WASHING MACHINE APPLIANCE

FIELD OF THE INVENTION

The present subject matter relates generally to washing machine appliances, or more specifically, to dispensing assemblies of washing machine appliances.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc. During a spin or drain cycle, a drain pump assembly may operate to discharge water from within sump.

Certain conventional washing machine appliances include dispensing assemblies that are configured to dispense water, wash fluid, and/or other additives into the wash chamber at various stages of the operating cycle to facilitate the cleaning of articles located therein. These dispensing assemblies may include a detergent drawer that includes multiple reservoirs for holding different additives and a water supply that selectively supplies water into the one or more reservoirs to flush the additives into the wash tub at desired times in the wash cycle.

However, conventional dispensing assemblies utilize a large number of components to regulate the fluid flow, e.g., such as multiple water valves, hoses, clamps, etc. For example, conventional dispensing assemblies use a separate cold water valve for each detergent reservoir, plus at least one additional hot water valve. Other dispensing assemblies rely on a water flow diverter to direct incoming water into different channels within the dispensing assembly. These components are costly, increase assembly time and complexity, and provide additional failure points where leaks or malfunctions may occur.

Accordingly, a washing machine appliance having a dispensing assembly with a minimal number of components would be desirable. More specifically, a dispensing assembly that reliably supplies wash additives with minimal cost and complexity would be particularly beneficial.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided, including a wash tub positioned within a cabinet and defining a wash chamber, a wash basket rotatably mounted within the wash tub for receiving a load of clothes, and a dispensing assembly mounted within the cabinet for selectively adding wash fluid into the wash tub. The dispensing assembly includes a dispenser housing fluidly coupled to the wash tub through a discharge port, a shower plate positioned above the dispenser housing and defining a plurality of water supply apertures and one or more reservoirs, the one or more reservoirs comprising a main wash reservoir, a detergent drawer slidably mounted below the shower plate, the detergent drawer defining one or more detergent chambers, and a first cold water valve, a second cold water valve, and a hot water valve configured to supply either cold water or hot water to the main wash reservoir.

In another exemplary embodiment, a dispensing assembly for providing a flow of wash fluid into a wash tub of a washing machine appliance is provided. The dispensing assembly includes a dispenser housing fluidly coupled to the wash tub through a discharge port, a shower plate positioned above the dispenser housing and defining a plurality of water supply apertures and one or more reservoirs, the one or more reservoirs comprising a main wash reservoir, a detergent drawer slidably mounted below the shower plate, the detergent drawer defining one or more detergent chambers, and a first cold water valve, a second cold water valve, and a hot water valve configured to supply either cold water or hot water to the main wash reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
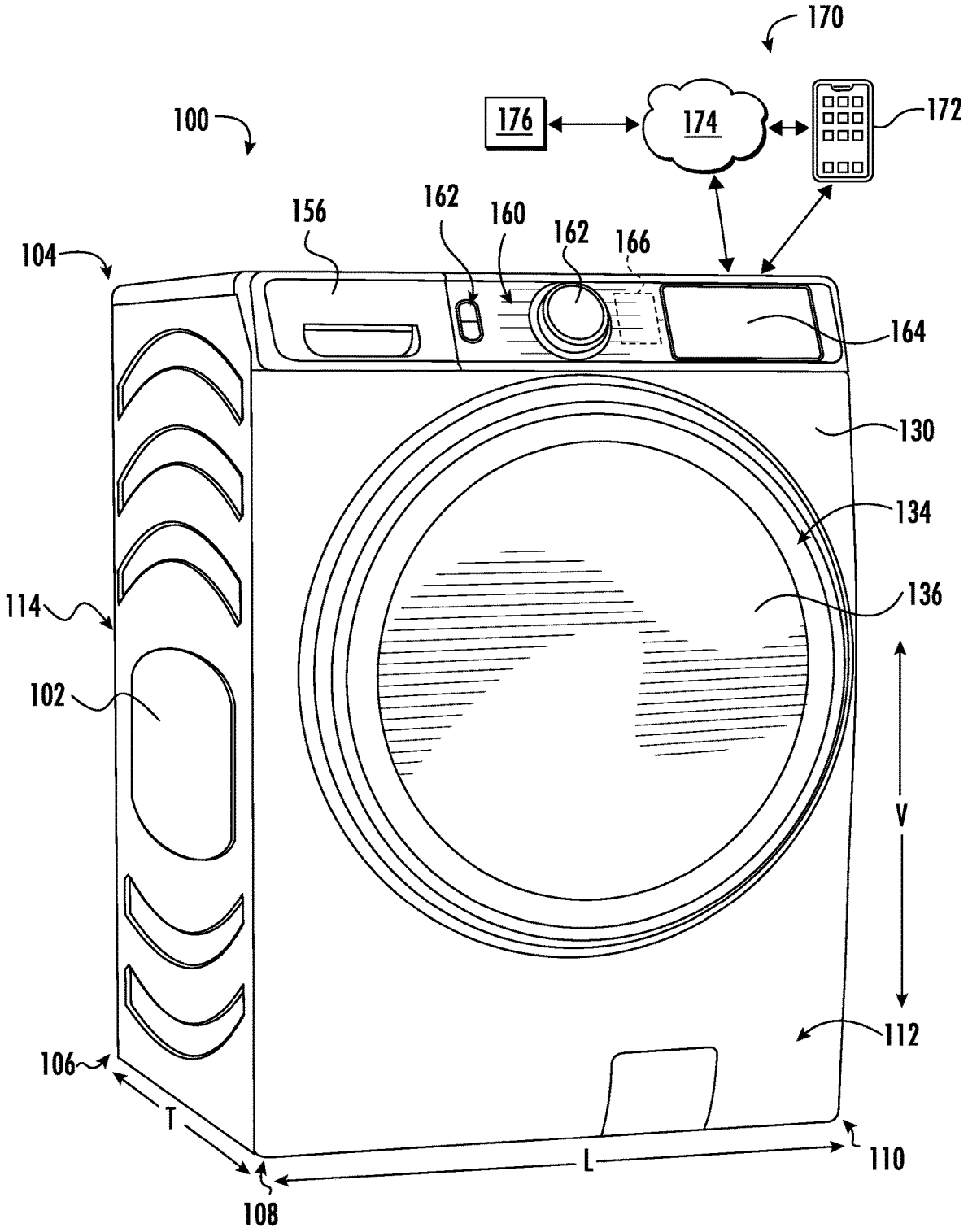
FIG. 1 provides a perspective view of a washing machine appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
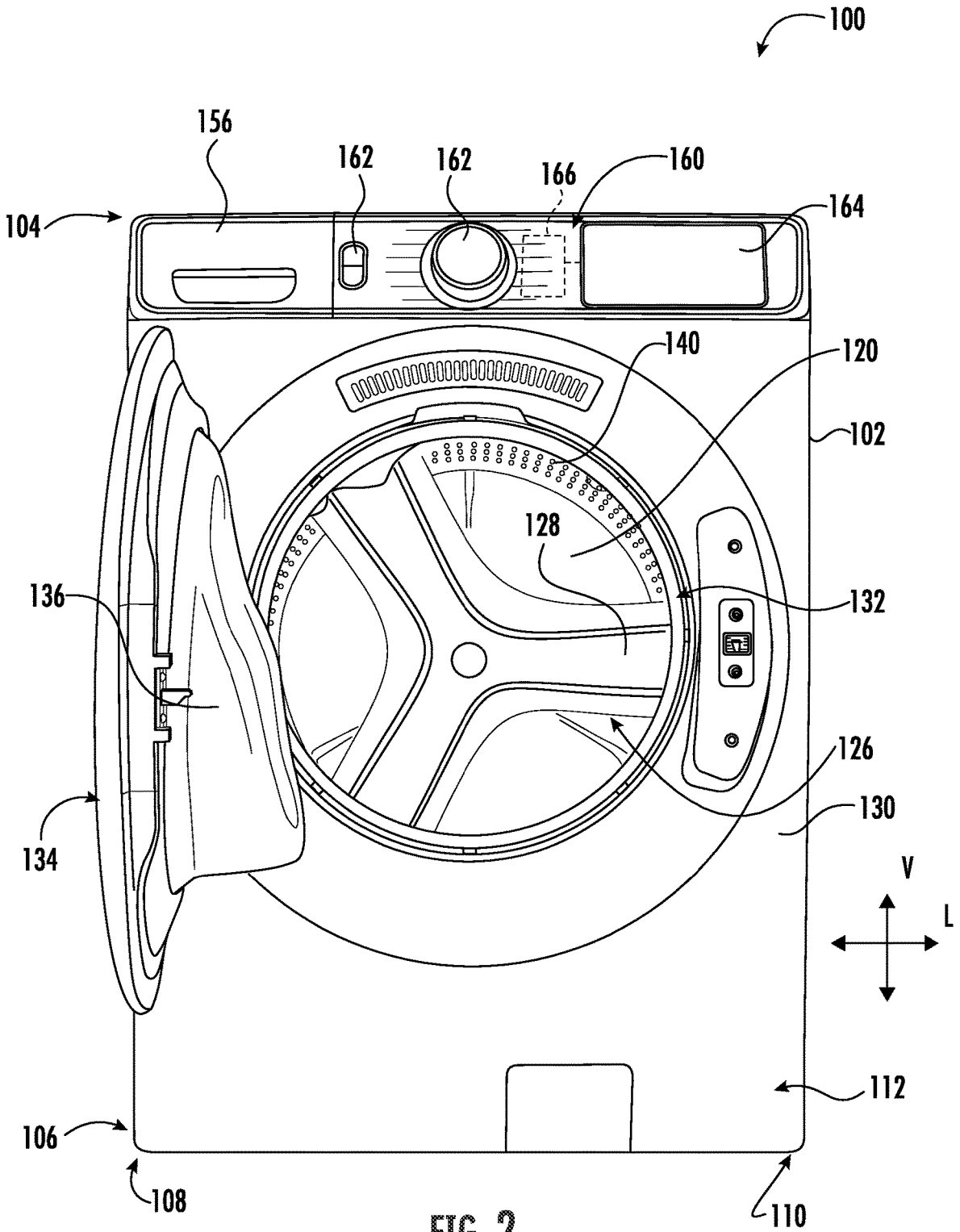
FIG. 2 provides a front view of the example washing machine appliance of FIG. 1 with a door in the open position according to an example embodiment of the present subject matter.
Figure 3:
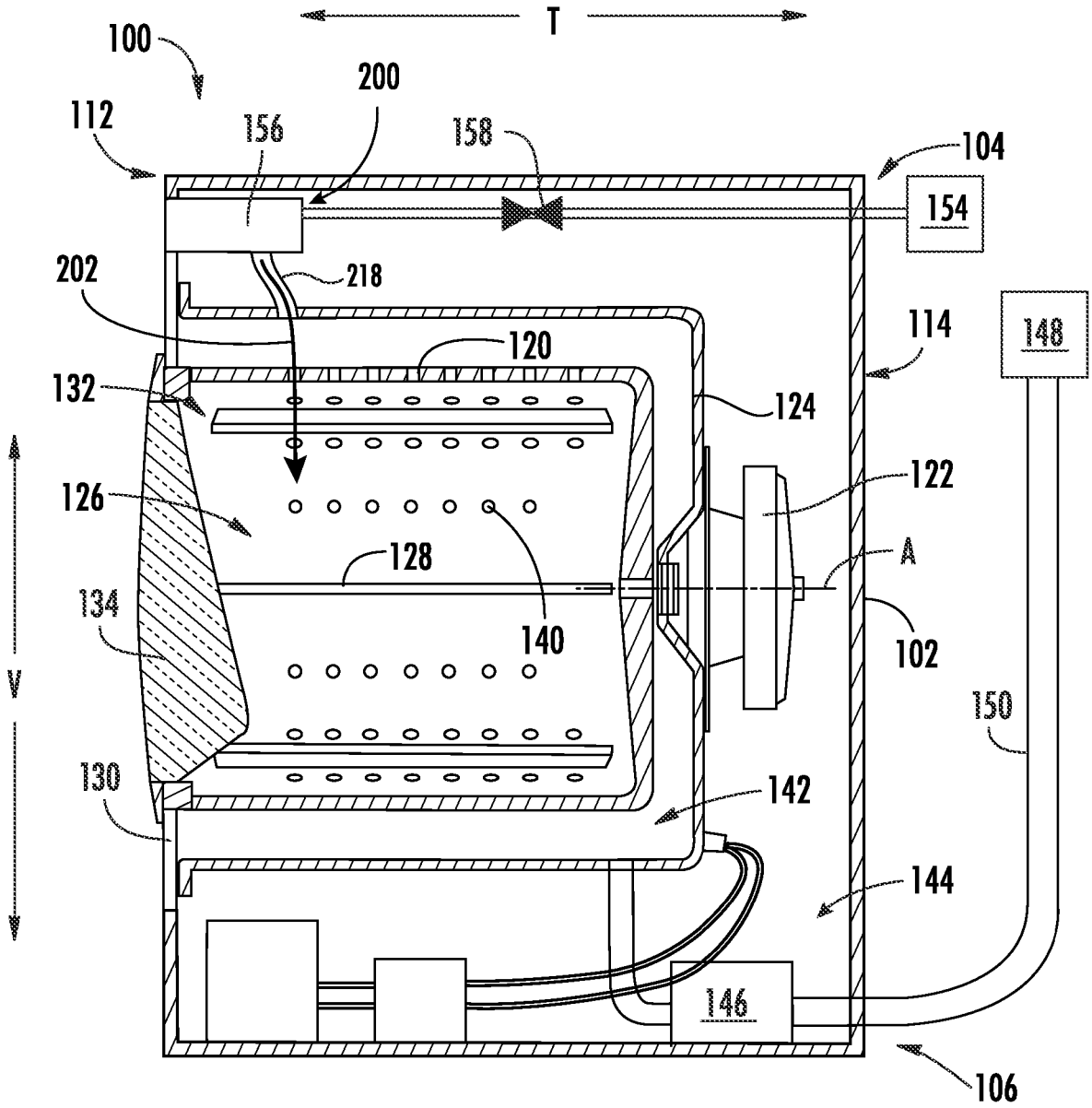
FIG. 3 provides a side cross-sectional view of the example washing machine appliance of FIG. 1 according to an example embodiment of the present subject matter.
Figure 4:
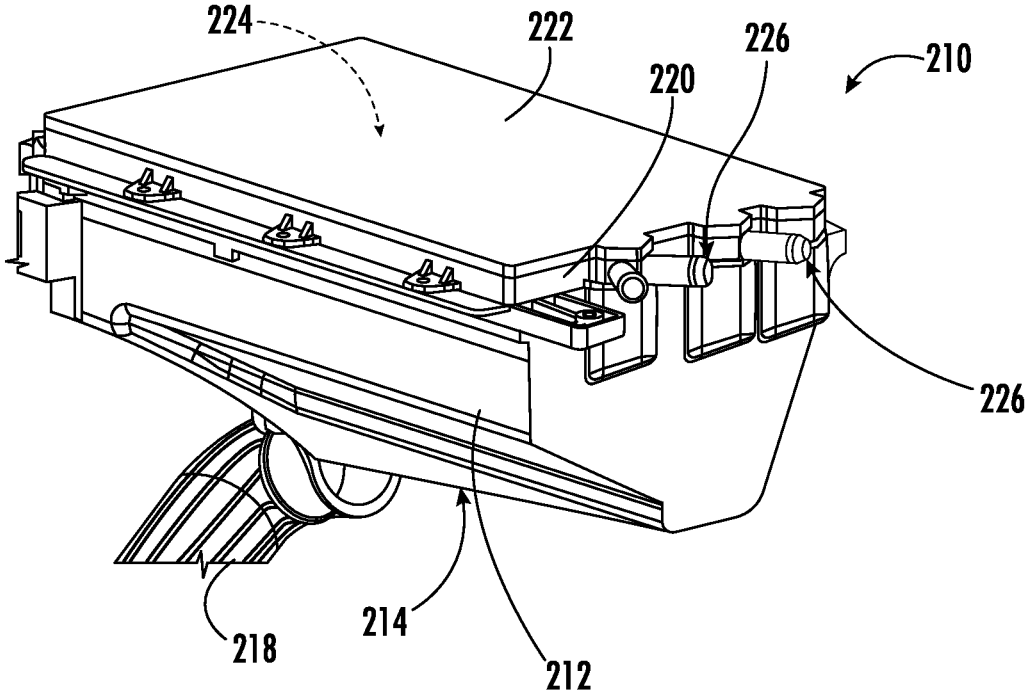
FIG. 4 provides a rear perspective view of a dispensing assembly of the example washing machine appliance of FIG. 1 according to an example embodiment of the present subject matter.
Figure 5:
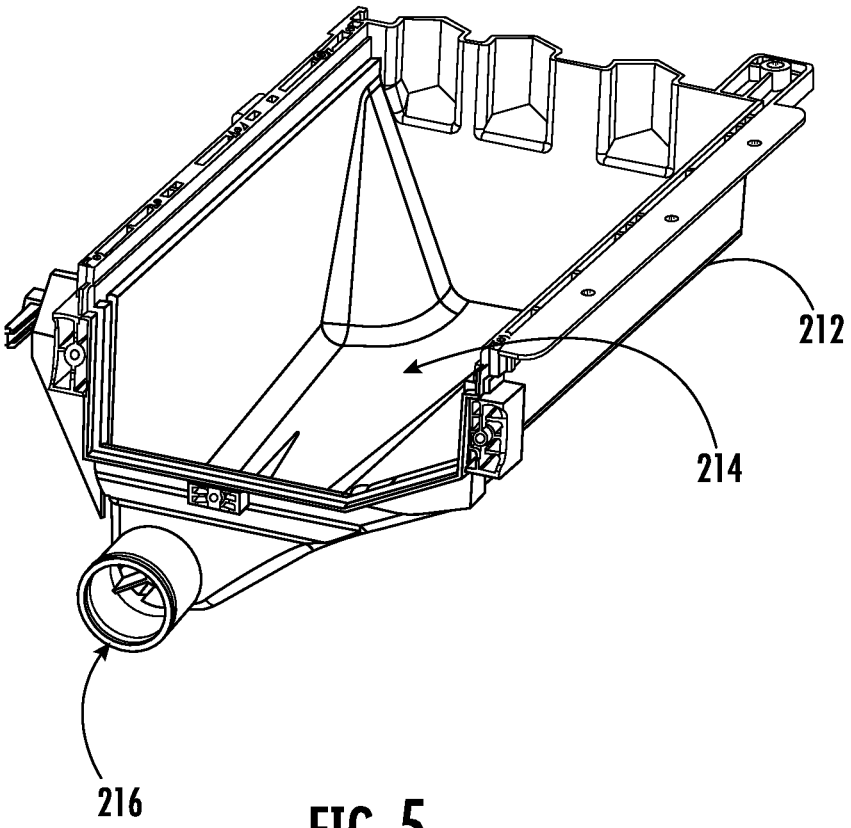
FIG. 5 provides a perspective view of a dispenser housing of the example dispensing assembly of FIG. 4 according to an example embodiment of the present subject matter.
Figure 6:
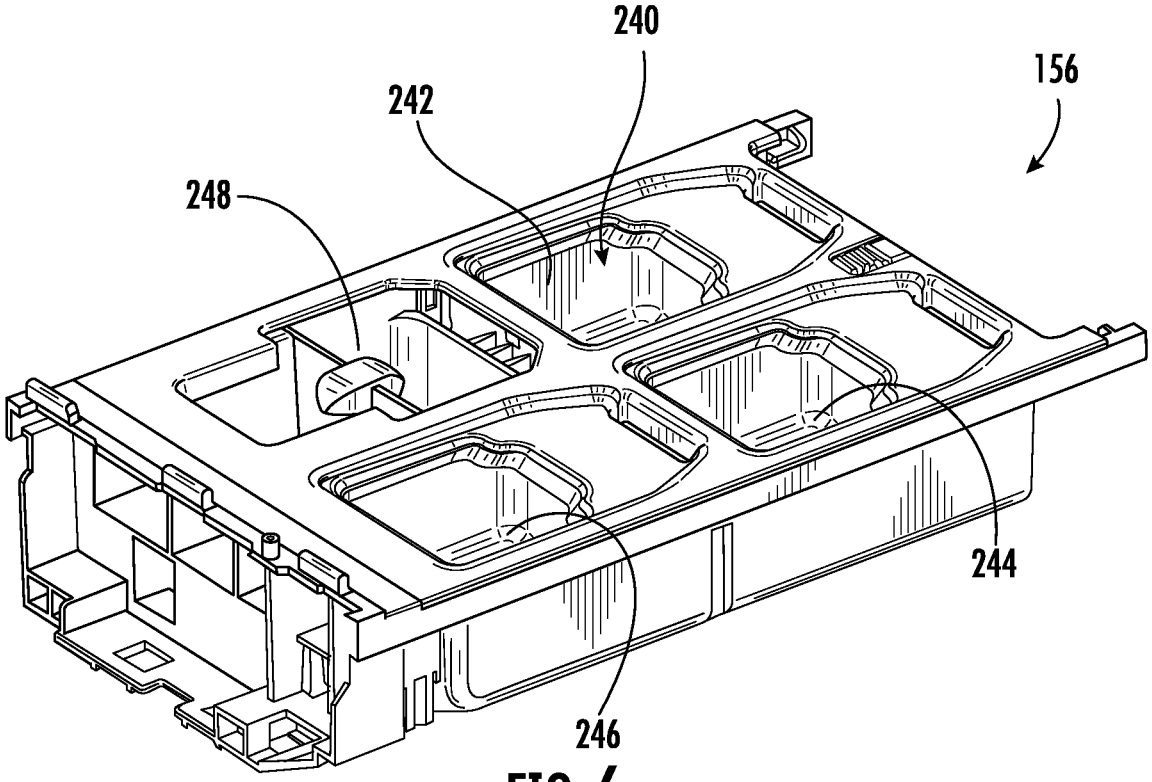
FIG. 6 provides a perspective view of a detergent drawer of the example dispensing assembly of FIG. 4 according to an example embodiment of the present subject matter.
Figure 7:
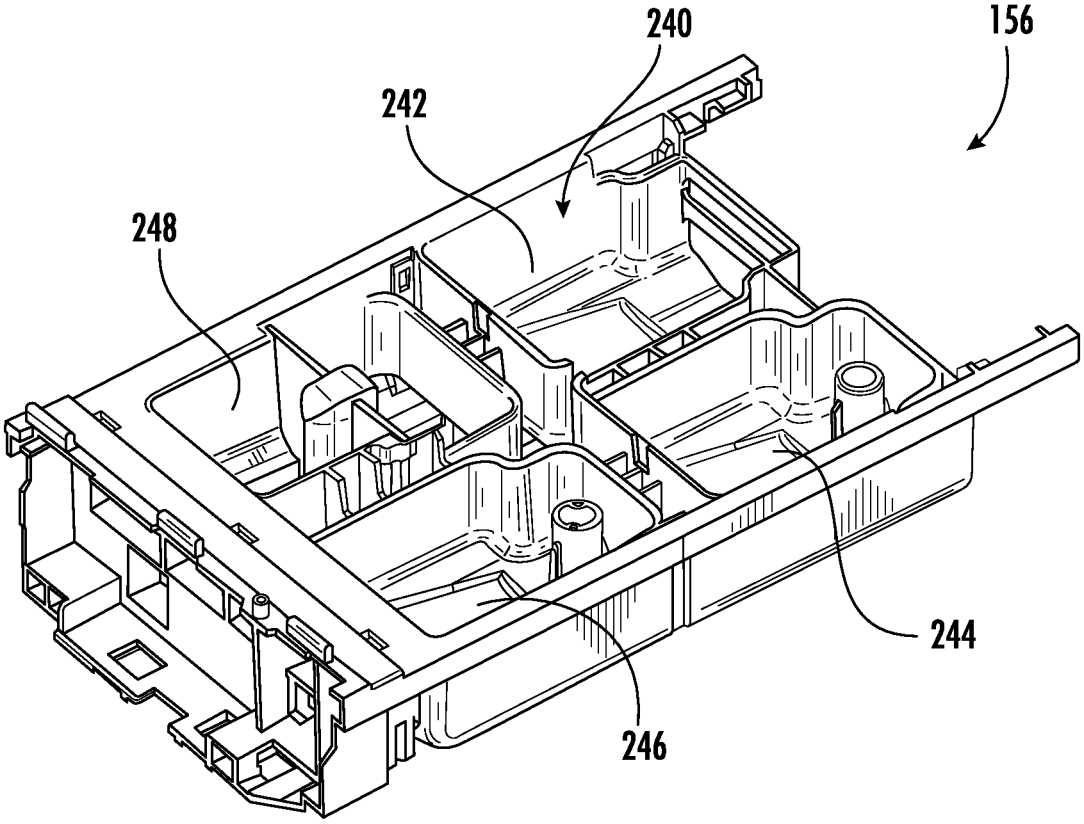
FIG. 7 provides another perspective view of the example detergent drawer of FIG. 6 according to an example embodiment of the present subject matter.

Referring now to the figures, FIG. 1 is a perspective view of an exemplary horizontal axis washing machine appliance 100, FIG. 2 is a front view of washing machine appliance 100, and FIG. 3 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIGS. 2 and 3, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof. Indeed, for simplicity of discussion, these terms may all be used interchangeably herein without limiting the present subject matter to any particular "wash fluid."

Wash basket 120 may define one or more agitator features that extend into wash chamber 126 to assist in agitation and cleaning articles disposed within wash chamber 126 during operation of washing machine appliance 100. For example, as illustrated in FIG. 3, a plurality of ribs 128 extends from basket 120 into wash chamber 126. In this manner, for example, ribs 128 may lift articles disposed in wash basket 120 during rotation of wash basket 120.

Referring generally to FIGS. 1 through 3, cabinet 102 also includes a front panel 130 which defines a chamber opening 132 that permits user access to wash basket 120 of wash tub 124. More specifically, washing machine appliance 100 includes a door 134 that is positioned over chamber opening 132 and is rotatably mounted to front panel 130. In this manner, door 134 permits selective access to chamber opening 132 by being movable between an open position (FIG. 2) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not labeled) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 3, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140.

A drain pump assembly 144 is located beneath wash tub 124 and is in fluid communication with sump 142 for periodically discharging soiled wash fluid from washing machine appliance 100. Drain pump assembly 144 may generally include a drain pump 146 which is in fluid communication with sump 142 and with an external drain 148 through a drain hose 150. During a drain cycle, drain pump 146 urges a flow of wash fluid from sump 142, through drain hose 150, and to external drain 148. More specifically, drain pump 146 includes a motor (not shown) which is energized during a drain cycle such that drain pump 146 draws wash fluid from sump 142 and urges it through drain hose 150 to external drain 148.

A spout (such as supply conduit 218) may be configured for directing a flow of fluid into wash tub 124. For example, supply conduit 218 may be in fluid communication with a water supply 154 (FIG. 2) in order to direct fluid (e.g., clean water or wash fluid) into wash tub 124. Supply conduit 218 may also be in fluid communication with the sump 142. For example, pump assembly 144 may direct wash fluid disposed in sump 142 to supply conduit 218 in order to circulate wash fluid in wash tub 124.

As illustrated in FIG. 3, a detergent drawer 156 is slidably mounted within front panel 130. Detergent drawer 156 receives a wash additive (e.g., detergent, fabric softener, bleach, or any other suitable liquid or powder) and directs the fluid additive to wash tub 124 during operation of washing machine appliance 100. According to the illustrated embodiment, detergent drawer 156 may also be fluidly coupled to supply conduit 218 to facilitate the complete and accurate dispensing of wash additive.

In addition, a water supply valve 158 may provide a flow of water from a water supply source (such as a municipal water supply 154) into detergent dispenser 156 and into wash tub 124. In this manner, water supply valve 158 may generally be operable to supply water into detergent dispenser 156 to generate a wash fluid, e.g., for use in a wash cycle, or a flow of fresh water, e.g., for a rinse cycle. It should be appreciated that water supply valve 158 may be positioned at any other suitable location within cabinet 102. In addition, although water supply valve 158 is described herein as regulating the flow of "wash fluid," it should be appreciated that this term includes, water, detergent, other additives, or some mixture thereof.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through chamber opening 132, and washing operation is initiated through operator manipulation of input selectors 162. Wash tub 124 is filled with water, detergent, and/or other fluid additives, e.g., via supply conduit 218 and or detergent drawer 156. One or more valves (e.g., water supply valve 158) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a final spin cycle, basket 120 is rotated at relatively high speeds and drain pump assembly 144 may discharge wash fluid from sump 142. After articles disposed in wash basket 120 are cleaned, washed, and/or rinsed, the user can remove the articles from wash basket 120, e.g., by opening door 134 and reaching into wash basket 120 through chamber opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances.

Referring still to FIG. 1, a schematic diagram of an external communication system 170 will be described according to an exemplary embodiment of the present subject matter. In general, external communication system 170 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 170 may be used to transfer data or other information to improve performance of one or more external devices or appliances and/or improve user interaction with such devices.

For example, external communication system 170 permits controller 166 of washing machine appliance 100 to communicate with a separate device external to washing machine appliance 100, referred to generally herein as an external device 172. As described in more detail below, these communications may be facilitated using a wired or wireless connection, such as via a network 174. In general, external device 172 may be any suitable device separate from washing machine appliance 100 that is configured to provide and/or receive communications, information, data, or commands from a user. In this regard, external device 172 may be, for example, a personal phone, a smartphone, a tablet, a laptop or personal computer, a wearable device, a smart home system, or another mobile or remote device.

In addition, a remote server 176 may be in communication with washing machine appliance 100 and/or external device 172 through network 174. In this regard, for example, remote server 176 may be a cloud-based server 176, and is thus located at a distant location, such as in a separate state, country, etc. According to an exemplary embodiment, external device 172 may communicate with a remote server 176 over network 174, such as the Internet, to transmit/receive data or information, provide user inputs, receive user notifications or instructions, interact with or control washing machine appliance 100, etc. In addition, external device 172 and remote server 176 may communicate with washing machine appliance 100 to communicate similar information.

In general, communication between washing machine appliance 100, external device 172, remote server 176, and/or other user devices or appliances may be carried using any type of wired or wireless connection and using any suitable type of communication network, non-limiting examples of which are provided below. For example, external device 172 may be in direct or indirect communication with washing machine appliance 100 through any suitable wired or wireless communication connections or interfaces, such as network 174. For example, network 174 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 170 is described herein according to an exemplary embodiment of the present subject matter. However, it should be appreciated that the exemplary functions and configurations of external communication system 170 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

Referring now generally to FIGS. 3 through 13, a fluid circulation assembly 200 that may be used with washing machine appliance 100 will be described according to example embodiments of the present subject matter. In general, fluid circulation assembly 200 may generally be configured for urging a flow of wash fluid (e.g., identified generally by reference numeral 202 in FIG. 3) throughout washing machine appliance 100. For example, the flow of wash fluid 202 may be water, detergent, additives, or some mixture thereof. According to example embodiments, fluid circulation assembly 200 may be configured to circulate the flow of wash fluid 202 within washing machine appliance 100 to facilitate cleaning of a load of articles or may be configured to discharge the flow of wash fluid 202 to an external drain 148. Although fluid circulation assembly 200 will be described below according to an example embodiment, it should be appreciated that variations and modifications may be made while remaining within the scope of the present subject matter.

According to the illustrated embodiment, fluid circulation assembly 200 may generally include a dispensing assembly 210 that is configured to receive and distribute the flow of wash fluid 202. For example, according to the illustrated embodiment, dispensing assembly 210 may generally include a dispenser manifold or a dispenser housing 212 that is positioned within or recessed within cabinet 102, e.g., at a top corner of front panel 130. According to the illustrated embodiment, dispenser housing 212 may be an open reservoir positioned at a bottom of dispensing assembly 210 and may include angled collecting wall 214 for directing fluids within dispenser housing 212 toward a discharge port 216. As shown for example in FIGS. 3 through 5, discharge port 216 may be fluidly coupled to a supply conduit 218 that is fluidly coupled to wash tub 124. In this manner, the flow of wash fluid 202 that is passed into dispenser housing 212 may be directed under the force of gravity into wash tub 124, e.g., to facilitate operation of washing machine appliance 100.

As best illustrated in FIGS. 4 and 8 through 13, dispensing assembly 210 may further include a shower plate 220 and a top cover 222 that is positioned over the shower plate 220 to define a water supply reservoir 224. Dispensing assembly 210 may further include a plurality of freshwater supply inlets 226 that are positioned at a rear of shower plate 220 for providing flows of hot and/or cold water into water supply reservoir 224, e.g., from water supply 154. In general, shower plate 220 may include a plurality of water supply apertures 228 or perforations for discharging the freshwater from water supply reservoir 224 down into dispenser housing 212. In this manner, fresh water and/or additives may be showered or flooded within dispenser housing 212 where they may be mixed prior to passing into wash tub 124 through supply conduit 218 (e.g., as flow of wash fluid 202).

In addition, as described briefly above, dispensing assembly 210 may include a detergent drawer 156 that is slidably mounted within dispenser housing 212 for receiving one or more wash additives or detergents. In this regard, a user may slide detergent drawer 156 out from front 112 of cabinet 102 for supplying wash additives needed for a wash cycle. Detergent drawer 156 may then slide back into dispensing assembly 210 where water supply 154 may selectively dispense fresh water to flush out one or more compartments of detergent drawer 156 and to create the flow of wash fluid 202.

As explained briefly above, detergent drawer 156 may be slidably mounted in dispenser housing 212 below shower plate 220. In addition, detergent drawer 156 may define one or more detergent chambers (e.g., identified herein generally by reference numeral 240). Detergent chambers 240 may be generally configured for storing one or more wash additives for use during a washing cycle. For example, according to the illustrated embodiment, detergent drawer 156 defines a pre-wash chamber 242, a bleach chamber 244, a fabric softener chamber 246, and a main wash chamber 248. It should be appreciated that according to alternative embodiments, detergent drawer 156 may define other chambers for receiving other wash additives while remaining within the scope of the present subject matter.

Shower plate 220 may generally be positioned over detergent drawer 156 when detergent drawer 156 is inserted into dispenser housing 212. In addition, shower plate 220 may generally divide water supply reservoir 224 into a plurality of reservoirs associated with one or more detergent chambers 240. In this regard, by flooding or injecting water into one of the plurality of reservoirs defined by shower plate 220, the water may pass through water supply apertures 228 into a respective detergent chamber 240. The water may then flush the detergent within detergent chamber 240 into dispenser housing 212 where it may be discharged into wash tub 124 through supply conduit 218 as a flow of wash fluid 202.

According to the illustrated embodiment, shower plate 220 may define four reservoirs that correspond to pre-wash chamber 242, bleach chamber 244, fabric softener chamber 246, and main wash chamber 248. Specifically, shower plate 220 may define a pre-wash reservoir 252, a bleach reservoir 254, a fabric softener reservoir 256, and a main wash reservoir 258. Accordingly, flooding these reservoirs of shower plate 220 may cause a respective additive to be dispensed into wash tub 124, e.g., such as a pre-wash agent, bleach, fabric softener, or a main wash detergent. Although an example configuration of chambers 242-248 and reservoirs 252-258 are illustrated and described herein, it should be appreciated that these chambers and reservoirs may be interchangeable or receive alternative additives while remaining within the scope of the present subject matter.

In general, dispensing assembly 210 may include a plurality of valves (e.g., such as water supply valve 158) that are fluidly coupled to a water supply (e.g., such as water supply 154) for providing a flow of water into water supply reservoir 224. More specifically, according to the illustrated embodiment, dispensing assembly 210 may include a first cold water valve 260, a second cold water valve 262, and a hot water valve 264. As shown, water valves 260-264 may be fluidly coupled to the inlet ports 226 that are defined on a back wall 268 of shower plate 220. As explained in more detail below, by selectively operating water valves 260-264, water may be selectively supplied into water supply reservoir 224 for dispensing each of the wash additives at a desired time of the wash cycle and at a desired fluid temperature.

Notably, as explained above, conventional dispensing assemblies require a dedicated water valve for each detergent chamber, along with a separate hot water valve. Moreover, conventional dispensing assemblies are unable to provide flexibility in dispensing hot water, cold water, or warm water (e.g., a mixture of cold and hot water) into the respective chambers. By contrast, the presently disclosed shower plate defines multiple merge points 270 carefully designed to merge flows of hot and cold water at desired locations, thereby providing improved versatility of water flow. Moreover, this varied water flow may be achieved with a minimal number of valves (e.g., three valves) and no other complex diverting or flow directing devices.

Figure 8:
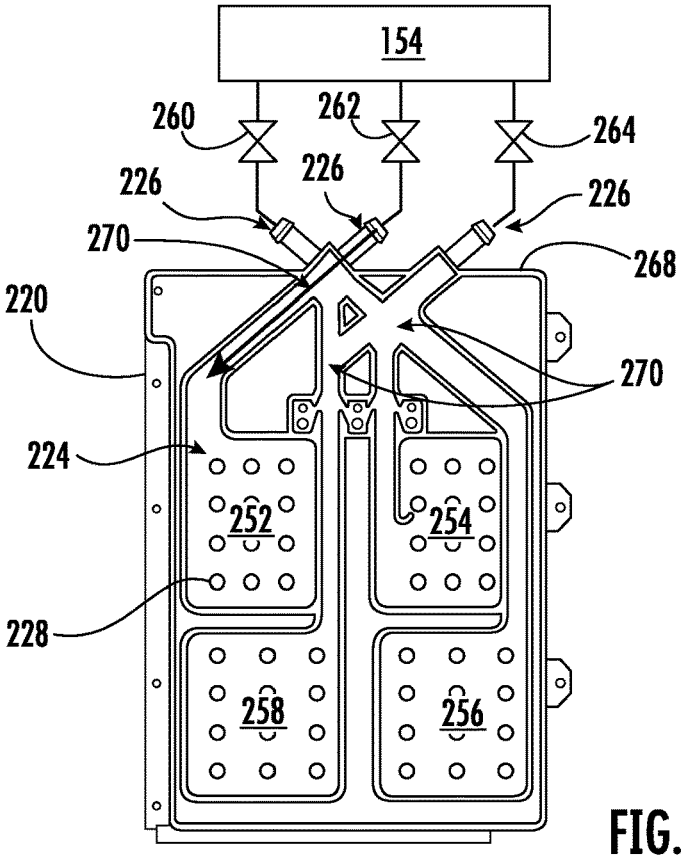
FIG. 8 provides a top view of a shower plate of the example dispensing assembly of FIG. 4 providing cold water to a pre-wash reservoir according to an example embodiment of the present subject matter.
Figure 9:
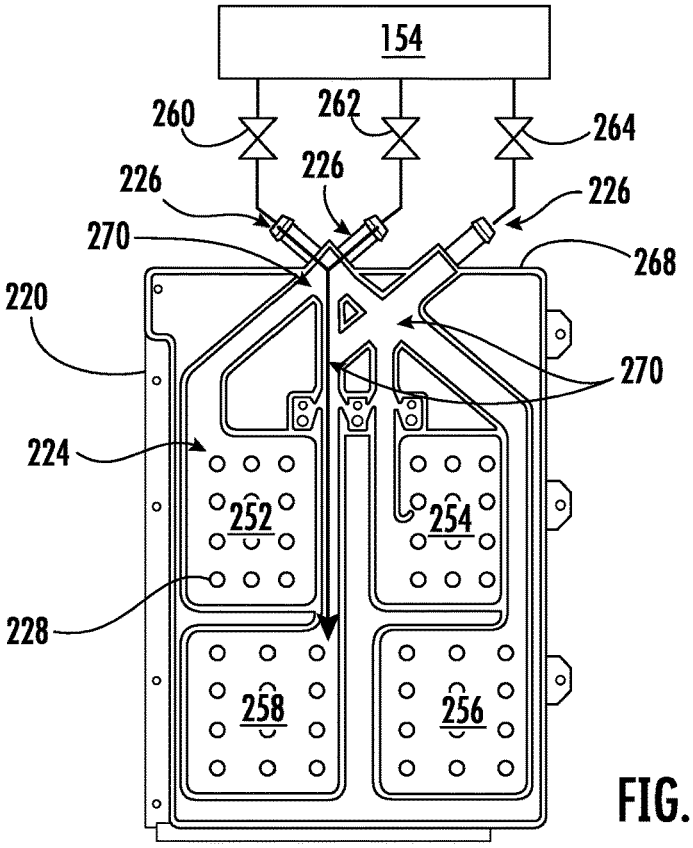
FIG. 9 provides a top view of a shower plate of the example dispensing assembly of FIG. 4 providing cold water to a main wash reservoir according to an example embodiment of the present subject matter.
Figure 10:
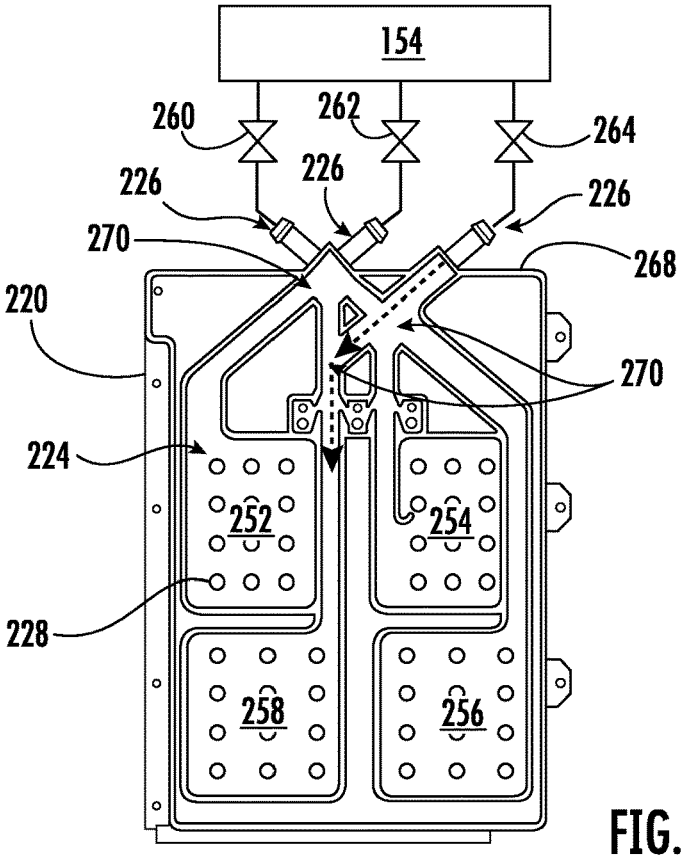
FIG. 10 provides a top view of a shower plate of the example dispensing assembly of FIG. 4 providing hot water to a main wash reservoir according to an example embodiment of the present subject matter.
Figure 11:
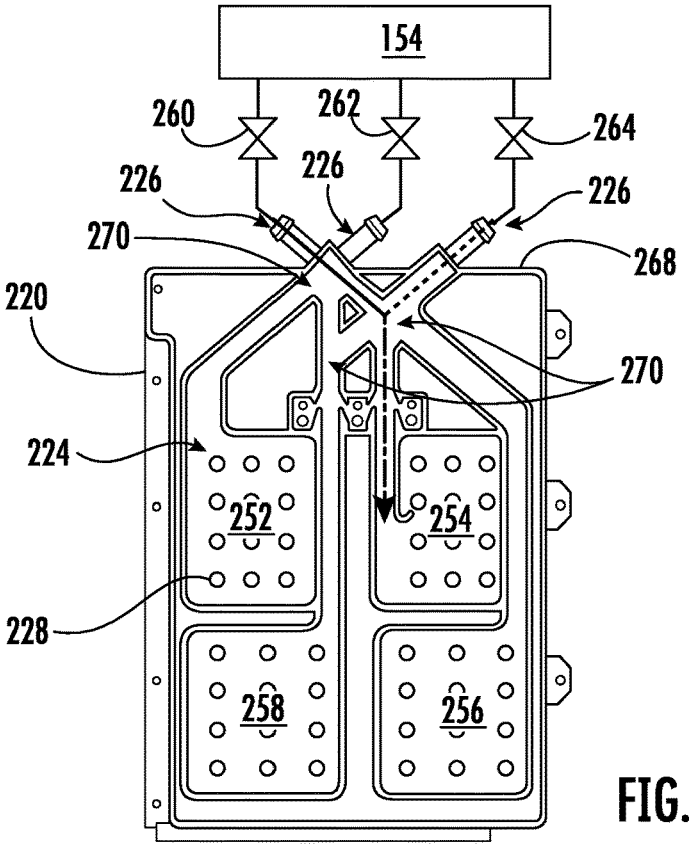
FIG. 11 provides a top view of a shower plate of the example dispensing assembly of FIG. 4 providing warm water to a bleach reservoir according to an example embodiment of the present subject matter.
Figure 12:
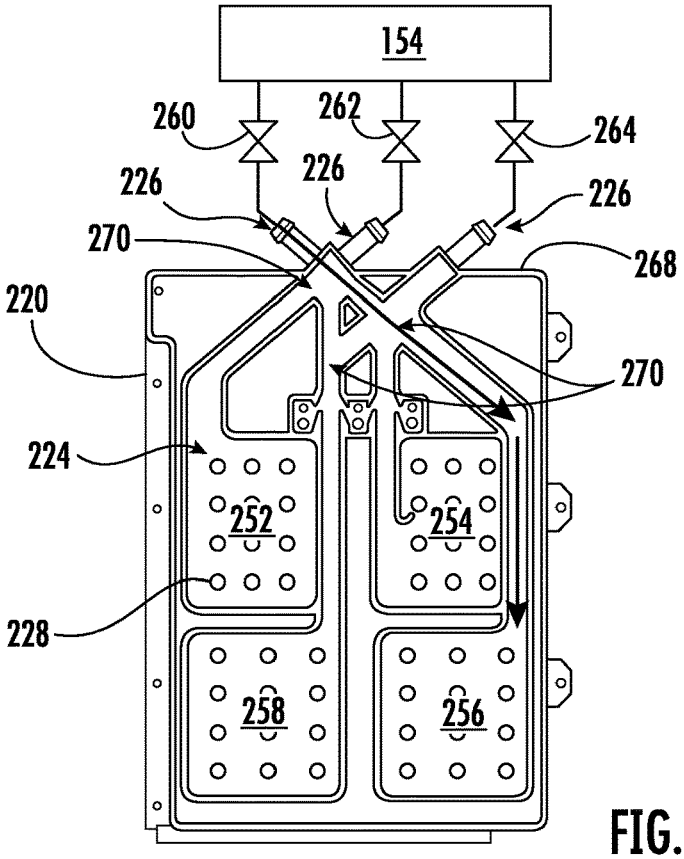
FIG. 12 provides a top view of a shower plate of the example dispensing assembly of FIG. 4 providing cold water to a fabric softener reservoir according to an example embodiment of the present subject matter.
Figure 13:
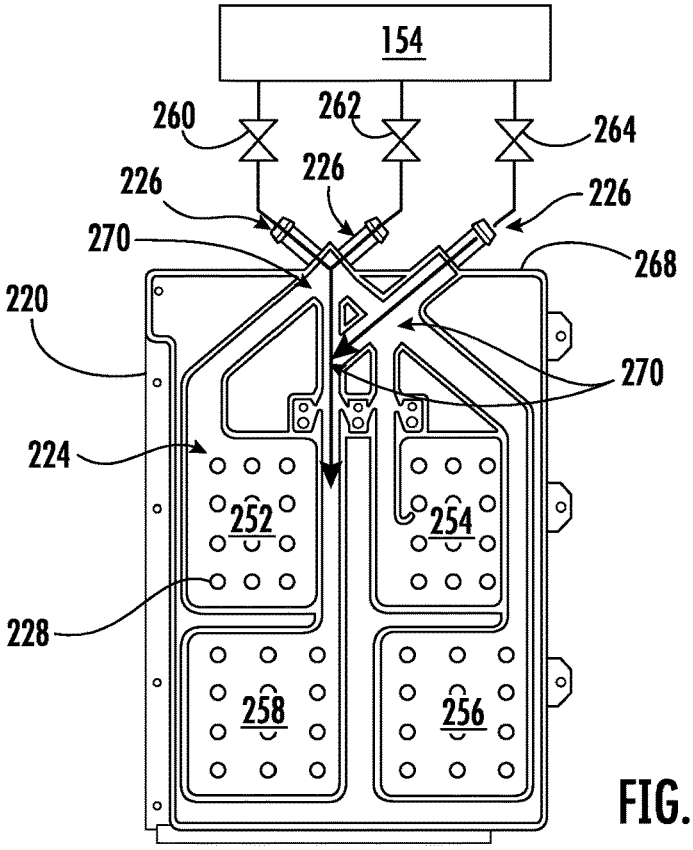
FIG. 13 provides a top view of a shower plate of the example dispensing assembly of FIG. 4 providing warm water to a main wash reservoir according to an example embodiment of the present subject matter.

For example, referring now briefly to FIG. 8, second cold water valve 262 may be opened to supply a flow of cold water directly to pre-wash reservoir 252. As shown in FIG. 9, opening both first cold water valve 260 and second cold water valve 262 may direct a flow of cold water to main wash reservoir 258 (e.g., by merging two flows of cold water at merge point 270). As shown in FIG. 10, opening hot water valve 264 may direct the flow of hot water to main wash reservoir 258. In addition, as shown in FIG. 13, opening first cold water valve 260, second cold water valve 262, and hot water valve 264 may direct a flow of warm water main wash reservoir 258 (e.g., by merging flows of cold and hot water at different merge points 270). As shown in FIG. 11, opening first cold water valve 260 and hot water valve 264 may direct a flow of warm water to bleach reservoir 254. In addition, as shown FIG. 12, opening first cold water valve 260 may supply a flow of cold water to fabric softener reservoir 256. It should be appreciated that other flow paths, merge points, and other fluid supply configurations may be used while remaining within the scope of the present subject matter.

As explained herein, aspects of the present subject matter are generally directed to a washing machine including a dispensing assembly (e.g., including shower plate assembly, diffuser, dispenser drawer, etc.) in which water streams are merged at the multiple zones for redirecting the path of the water flow. The dispenser may include four regions: a pre-wash reservoir located in the rear left region of the dispenser drawer; a main wash reservoir located in the front left region of the drawer; a bleach reservoir located in the rear right region; and a fabric softener reservoir located in the front right region of the drawer. The dispenser system may utilize only three water valves (e.g., two cold and one hot) to operate. During a pre-washing agent dispensing and the fabric softener dispensing, only one valve may be actuated i.e., the cold water valve "Cold 2" may be actuated to direct water to the pre-wash reservoir, and the cold water valve "Cold 1" may be actuated to direct water to the fabric softener reservoir. During the main wash, water stream from two different water valves ("Cold 1" and "Cold 2") may be merged to direct the flow of water through the channel leading to the main wash reservoir. Further, the flow of the hot water to the main wash reservoir may be accomplished with the actuation of the hot valve only. During the dispense of the fabric softener, water stream from two different valves may be merged ("Cold 1 and "Hot") and then the water may flow through the channel leading to the fabric softener reservoir. The dispensing assembly described herein reduces the number of water valves required to dispense a given number of wash system additives. By reducing the number of water valves, the number of hoses and clamps connecting the water valves to the dispenser assembly are also reduced. This results in a lower cost for both purchased materials and for the labor required to assemble the water valves, hoses, and clamps.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:
- a wash tub positioned within a cabinet and defining a wash chamber;
- a wash basket rotatably mounted within the wash tub for receiving a load of clothes; and
- a dispensing assembly mounted within the cabinet for selectively adding wash fluid into the wash tub, the dispensing assembly comprising:
  - a dispenser housing fluidly coupled to the wash tub through a discharge port;
  - a shower plate positioned above the dispenser housing and defining a plurality of water supply apertures and one or more reservoirs, the one or more reservoirs comprising a main wash reservoir;
  - a detergent drawer slidably mounted below the shower plate, the detergent drawer defining one or more detergent chambers; and
  - a first cold water valve, a second cold water valve, and a hot water valve configured to supply either cold water or hot water to the main wash reservoir, wherein the first cold water valve, the second cold water valve, and the hot water valve are configured to supply the cold water or the hot water to the main wash reservoir and at least three additional reservoirs of the one or more reservoirs, wherein each of the main wash reservoir and the at least three additional reservoirs are selectively and independently supplied with the cold water or the hot water.

2. The washing machine appliance of claim 1, wherein the one or more reservoirs includes four reservoirs.

3. The washing machine appliance of claim 1, wherein inlet ports for the first cold water valve, the second cold water valve, and the hot water valve are defined on a back wall of the shower plate.

4. The washing machine appliance of claim 1, wherein the one or more reservoirs comprise a pre-wash reservoir, a bleach reservoir, a fabric softener reservoir, and the main wash reservoir.

5. The washing machine appliance of claim 4, wherein the second cold water valve is opened to supply a flow of cold water to the pre-wash reservoir.

6. The washing machine appliance of claim 4, wherein the first cold water valve and the second cold water valve are opened to supply a flow of cold water to the main wash reservoir.

7. The washing machine appliance of claim 4, wherein the hot water valve is opened to supply a flow of hot water to the main wash reservoir.

8. The washing machine appliance of claim 4, wherein the first cold water valve, the second cold water valve, and the hot water valve are opened to supply a flow of warm water to the main wash reservoir.

9. The washing machine appliance of claim 4, wherein the first cold water valve and the hot water valve are opened to supply a flow of warm water to the bleach reservoir.

10. The washing machine appliance of claim 4, wherein the first cold water valve is opened to supply a flow of cold water to the fabric softener reservoir.

11. The washing machine appliance of claim 1, wherein the washing machine appliance is a front load washing machine appliance.

12. A dispensing assembly for providing a flow of wash fluid into a wash tub of a washing machine appliance, the dispensing assembly comprising:

a dispenser housing fluidly coupled to the wash tub through a discharge port;

a shower plate positioned above the dispenser housing and defining a plurality of water supply apertures and one or more reservoirs, the one or more reservoirs comprising a main wash reservoir;

a detergent drawer slidably mounted below the shower plate, the detergent drawer defining one or more detergent chambers; and a first cold water valve, a second cold water valve, and a hot water valve configured to supply either cold water or hot water to the main wash reservoir, wherein the first cold water valve, the second cold water valve, and the hot water valve are configured to supply the cold water or the hot water to the main wash reservoir and at least three additional reservoirs of the one or more reservoirs, wherein each of the main wash reservoir and the at least three additional reservoirs are selectively and independently supplied with the cold water or the hot water.

13. The dispensing assembly of claim 12, wherein the one or more reservoirs includes four reservoirs.

14. The dispensing assembly of claim 12, wherein the one or more reservoirs comprise a pre-wash reservoir, a bleach reservoir, a fabric softener reservoir, and the main wash reservoir.

15. The dispensing assembly of claim 14, wherein the second cold water valve is opened to supply a flow of cold water to the pre-wash reservoir.

16. The dispensing assembly of claim 14, wherein the first cold water valve and the second cold water valve are opened to supply a flow of cold water to the main wash reservoir.

17. The dispensing assembly of claim 14, wherein the hot water valve is opened to supply a flow of hot water to the main wash reservoir.

18. The dispensing assembly of claim 14, wherein the first cold water valve, the second cold water valve, and the hot water valve are opened to supply a flow of warm water to the main wash reservoir.

19. The dispensing assembly of claim 14, wherein the first cold water valve and the hot water valve are opened to supply a flow of warm water to the bleach reservoir.

20. The dispensing assembly of claim 14, wherein the first cold water valve is opened to supply a flow of cold water to the fabric softener reservoir.

* * * * *